United States Patent [19]

Matsumoto et al.

[11] 3,937,960

[45] Feb. 10, 1976

[54] CHARGING DEVICE FOR ELECTROPHOTOGRAPHY

[75] Inventors: Seiji Matsumoto, Asaka; Isoji Takahashi, Tokyo, both of Japan

[73] Assignee: Rank Xerox, Ltd., London, England

[22] Filed: May 3, 1974

[21] Appl. No.: 466,763

Related U.S. Application Data

[63] Continuation of Ser. No. 227,970, Feb. 22, 1972, abandoned.

[52] U.S. Cl. ..... 250/326; 250/324; 317/262 A

[51] Int. Cl.[2] ..... G03G 13/00

[58] Field of Search..... 250/324, 325, 326; 313/262 A

[56] References Cited

UNITED STATES PATENTS

| | | | |
|---|---|---|---|
| 3,358,289 | 12/1967 | Polee | 250/49.5 |
| 3,541,329 | 11/1970 | Roth | 250/49.5 |
| 3,655,966 | 4/1972 | Takimoto et al. | 250/49.5 |
| 3,811,048 | 5/1974 | Matsumoto et al. | 250/325 |

*Primary Examiner*—James W. Lawrence
*Assistant Examiner*—B. C. Anderson

[57] ABSTRACT

A charging device for an electrophotographic apparatus wherein at least a first portion of a control plate is movable relative to a corona generating device. A support member having a photoconductive insulating layer is maintained in spaced relationship relative to the corona generating device. A suitable mechanism is operably associated with the control plate for varying the position of at least the first portion of the control plate relative to the corona generating device to thereby adjust the strength of the corona discharge from the portion of the corona generating device generally adjacent the first portion of the control plate.

4 Claims, 4 Drawing Figures

CHARGING DEVICE FOR ELECTROPHOTOGRAPHY

This is a continuation of application Ser. No. 227,970, filed Feb. 22, 1972, now abandoned.

BACKGROUND OF THE INVENTION

This invention relates generally to electrophotography, and more particularly to a charging device in which the strength of the corona discharge from a suitable corona generating device may be partially varied to obtain a desired charge on an ion receiving surface.

As is well known in the art, the electrostatic photography process is achieved by uniformly charging a photoconductive insulating layer provided on an electrically conductive support member wherein the layer is treated as a photosensitive layer, exposing the photoconductive layer to an image, and, then, effecting toner development of the image.

During the charging step, the support member has to be grounded. However, it is difficult to obtain a good grounded condition when the support member is formed of flexible material. For example, where the support member is formed of a plastic film or paper made of material such as polyester, triacetate, cellophane, or resin coated paper, it is very difficult to obtain uniform charging of the photosensitive layer. When it is desired to charge a photosensitive layer provided on a support member of the type noted above, it is common in the art to ground the peripheral portions of the support member prior to the commencement of the charging operation. However, the center portion of the member is not grounded thereby decreasing the charge that is obtained on the portion of the surface of the photosensitive layer contacting the ungrounded center portion of the member. In order to obtain a uniform charge on the surface of the photosensitive layer, it is necessary to provide additional means to supply added charging to the central portion of the layer.

Further, as is well known in the art of electrostatic photography, there occurs what is commonly referred to as the "edge effect" whereby the peripheral portion of an image is developed dark and the center portion is light. This is most noticeable when a relatively wide solid area image is to be developed. Thus, in order to minimize the edge effect, it is desirable to charge the center portion of a relatively wide solid area image to a greater level when compared to the remaining portions, to thereby obtain a copy of substantially uniform contrast.

SUMMARY OF THE INVENTION

Accordingly, it is an object of the present invention to provide a charging device for charging the photosensitive layer utilized in electrostatic photography by which a portion of the layer may be charged to a greater level relative to other portions of the photosensitive layer.

It is a further object of the invention to provide a charging device operable to charge a photosensitive layer contacting an ungrounded support member to the same level as a photosensitive layer contacting a grounded support member.

It is yet another object of the present invention to provide a charging device having first and second portions, wherein the strength of the corona generated by the first portion is of a greater magnitude when compared to the strength of the corona generated by the second portion.

These and other objects of the present invention are obtained by providing a corona discharge device including a conductive fine wire connected to a source of high DC voltage. The wire is supported in space relationship relative to an ion receiving surface which is to be charged.

A control plate formed of a flexible conductive material is operatively associated with the fine wire and is supported in spaced relationship relative to the ion receiving surface and to the fine wire. A suitable mechanism is connected to the control plate for moving at least a first portion of the plate relative to the wire and surface. The movement of the control plate relative to the ion receiving surface and the fine wire produces a corresponding variation in the ion flow between the wire and ion receiving surface.

DESCRIPTION OF THE PREFERRED EMBODIMENTS

Figure 1:
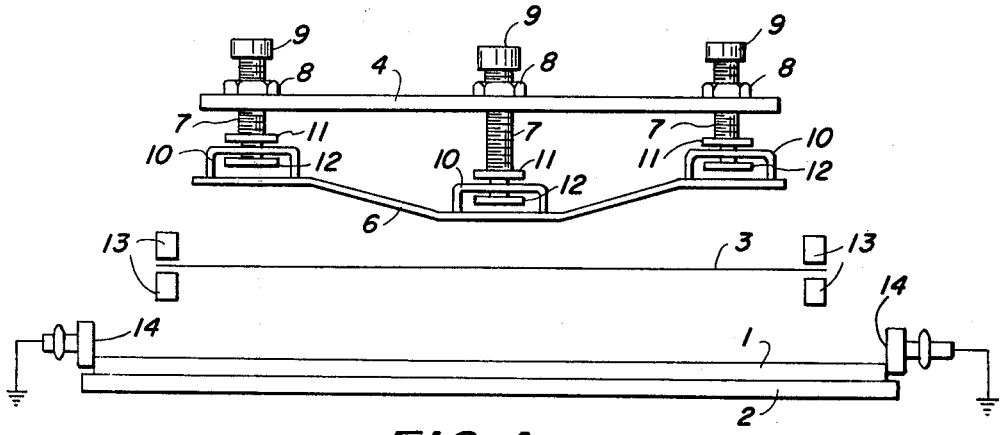
FIG. 1 illustrates a preferred embodiment of a charging device in accordance with the present invention.

Referring now to the drawings, there are illustrated several embodiments in accordance with the present invention. In referring to the drawings, like numerals shall refer to like parts.

Figure 2:
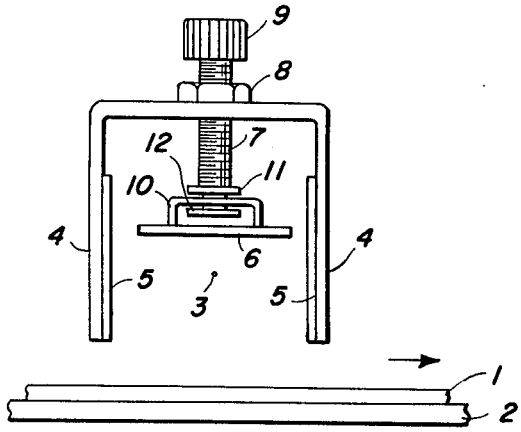
FIG. 2 is a side view of the charging device shown in FIG. 1.

Referring in particular to FIGS. 1 and 2 there is shown a first embodiment of a charging device in accordance with the present invention. Paper or similar member 1 having a photosensitive or photoconductive insulating layer to be charged is positioned on conveyor 2 whereby paper 1 is advanced at a predetermined speed through the various stages of a conventional electrostatic photographic process. As illustrated in FIG. 1, the path of travel for the paper is from the front of the drawing paper towards the back thereof. Corona discharge electrode 3 comprises a conductive fine wire of about 20–100 mils in diameter. Generally a high DC voltage, on the order of 3–10 KV is applied to the wire from a source not shown. A shielding case 4 for the wire includes an electrically insulative layer 5. A discharge control plate 6 formed of a flexible conductive material, for example a relatively thin piece of metal, is spaced apart from wire 3. Wire 3 and plate 6 form a pair of electrodes for corona discharging.

A suitable mechanism is connected to plate 6 for varying the distance between the plate and wire as desired. Such a mechanism may include a screw 7 which is movably positioned in shield 4 and is attached to collars 11 and 12. A nut 8 is suitably affixed to the shield and functions as a guide for screw 7. A knob or other device 9 may be affixed to one end of the screw for moving the screw relative to the shield as is desired. A metal fitting 10 is connected to control plate 6. Collars 11 and 12 are spaced about fitting 10 so that the movement of screw 7 is transmitted to plate 6 whereby the position of the plate relative to wire 3 may be varied. Wire 3 is suitably supported by members 13. Electrically conductive rollers 14 are provided for grounding the peripheral portions of photosensitive paper 1.

As noted before, discharge control plate 6 used in the illustrated device is electrically conductive and is flexible. The plate is generally grounded; however, the plate may be alternatively supplied with a low voltage, preferably not higher than 100 volts.

As is illustrated in FIG. 1, the photosensitive paper contacts the electrically conductive rollers 14 only at its peripheral portions. However, since the support member of the photosensitive paper has a relatively large electrical resistance, and the center portion of the paper is ungrounded, such center portion may have only a relatively small amount of charge on its surface when compared to the grounded peripheral portions, when the paper has been subjected to corona discharge from wire 3.

The space between discharge control plate 6 and wire 3 may be suitably adjusted by the mechanism heretofore described. It should be noted that a plurality of such mechanisms are provided at several locations along the length of plate 6.

If it is noted that the center portion of the surface of photosensitive paper 1 becomes short of electric charge due to its ungrounded condition, the center portion of plate 6 may be moved closer to corona discharge wire 3. The corona discharge about the portion of wire 3 adjacent to the center portion of plate 6 becomes stronger as the plate is moved towards the wire thereby resulting in an increased flow of ions towards the portion of the photosensitive surface contacting the ungrounded support member. In response to the increased flow of ions, the center or ungrounded portion of the photosensitive paper has an increased electrical charge provided on its surface. The increased corona discharge obtained by the movement of plate 6 towards wire 3 compensates for the ungrounded condition of the center portion of the paper and thus uniform charging may be obtained.

It should be noted that control plate 6 may be moved in its entirety relative to wire 3 by adjusting all of the mechanisms simultaneously.

It should be further noted that insulation layer 5 provided inside shielding case 4 is included in order to enhance the control function of plate 6. Without a suitable insulating layer, if the conductive shielding case 4 were positioned so as to oppose corona discharging wire 3, there would occur corona discharging therebetween and the control effect of plate 6 might be diminished. It is of course possible to manufacture the pertinent portions of the shielding case from an insulative material, or in the alternative, if there is enough space between the corona discharging wire 3 and the shielding case there is no need to provide an insulating layer 5.

Figure 3:
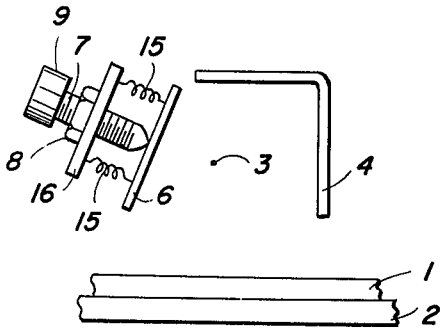
FIG. 3 illustrates another embodiment of the charging device.

FIG. 3 shows another embodiment of the present invention in which the discharge control plate 6 is positioned sideways relative to wire 3. Shielding plate 4 is made of an insulating material. Springs 15 are interposed between a fixed plate 16 and discharge control plate 6 and serve to maintain the discharge control plate on the point of screw 7. By the foregoing construction, the height of the discharge control plate may be selectively adjusted by rotating knob 9.

Figure 4:
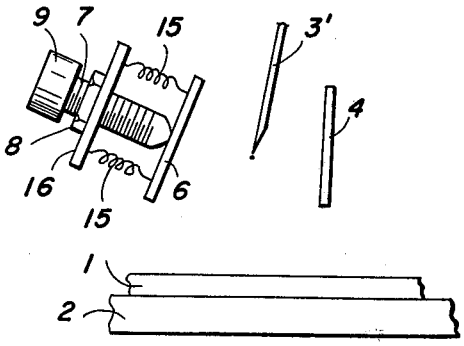
FIG. 4 illustrates still another embodiment of the charging device.

FIG. 4 shows a still further embodiment of the present invention wherein, in lieu of the conductive fine wire, a number of needle like electrodes 3′ are arranged in a single row and are employed as the corona discharging electrode.

Desired corona discharging may be obtained by positioning respective points of the needle like elements 3′ in the previously occupied position of the fine wire as to form a single line. This embodiment can also provide a uniform charging of the photosensitive layer of paper 1 by suitably adjusting the position of discharge control plate 6.

Thus, according to the present invention, the corona discharge obtained from a suitable corona discharge device may be partially varied so as to obtain a desired charge on an ion receiving surface.

It should be further understood that, although the charging device of the present invention has been particularly described with respect to charging a photoconductive insulating surface, it should be particularly understood that the device may be otherwise employed in an electrophotographic process without departing from the spirit of the invention.

While the invention has been described with reference to preferred arrangements and embodiments, it will be generally understood by those skilled in the art that various changes may be made and equivalents may be substituted for elements thereof without departing from the true spirit and scope of the invention.

What is claimed is:

1. In combination a chargable insulating surface having a directly grounded portion and another portion which is not directly grounded, corona electrode means overlying said surface, said electrode means having a first segment overlying said directly grounded portion and a second segment overlying said portion of said surface which is not directly grounded, and movable control plate means for varying the corona discharge generated adjacent said first segment relative to the corona discharge adjacent said second segment, whereby the flow of charge from said second segment to said indirectly grounded portion is greater than that from said first segment to said portion which is directly grounded.

2. The combination recited in claim 1 wherein said plate means comprises an elongated flexible member spaced from and extending collateral to said electrode means and means for moving a first section of said plate relative to said electrode means while maintaining a second section of said plate at a substantially constant distance from said electrode means.

3. The combination recited in claim 1 wherein said electrode comprises an elongated wire and said plate means comprises a movable first conductive plate section collateral with said wire over substantially less than the entire length thereof and means for moving said first section relative to other sections of said plate means.

4. The combination recited in claim 3 further comprising at least one insulating side wall member partially surrounding said wire.

* * * * *